US006851664B2

(12) United States Patent
Gangler et al.

(10) Patent No.: US 6,851,664 B2
(45) Date of Patent: Feb. 8, 2005

(54) SELF-RELIEVING CHOKE VALVE SYSTEM FOR A COMBUSTION ENGINE CARBURETOR

(75) Inventors: Bryan K. Gangler, Unionville, MI (US); Donald W. Warner, Cass City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 10/438,641

(22) Filed: May 15, 2003

(65) Prior Publication Data

US 2004/0227261 A1 Nov. 18, 2004

(51) Int. Cl.[7] ..... F02M 1/14

(52) U.S. Cl. ..... 261/64.3; 261/39.2; 261/64.4; 261/64.6

(58) Field of Search ..... 261/64.3, 64.4, 261/64.6, 39.1–39.3

(56) References Cited

U.S. PATENT DOCUMENTS

| | | | | |
|---|---|---|---|---|
| 4,038,955 A | | 8/1977 | Paulmier | 261/39.3 |
| 4,044,736 A | | 8/1977 | Tateno et al. | 261/39.6 |
| 4,058,097 A | | 11/1977 | Hutton et al. | 261/39.6 |
| 4,113,808 A | * | 9/1978 | Hackbarth et al. | 261/52 |
| 4,202,302 A | * | 5/1980 | Tamura | 261/39.3 |
| 4,334,511 A | * | 6/1982 | Atsumi et al. | 123/454 |
| 4,439,377 A | * | 3/1984 | Nartowski | 261/52 |
| 4,456,568 A | | 6/1984 | Taifu et al. | 261/39.2 |
| 4,463,723 A | | 8/1984 | Tansuwan | 123/438 |
| 4,482,508 A | * | 11/1984 | Onaka et al. | 261/39.2 |
| 4,672,929 A | * | 6/1987 | Wissmann et al. | 123/179.18 |
| 4,770,823 A | | 9/1988 | Sejimo | 261/39.1 |
| 4,951,926 A | * | 8/1990 | O'Shea et al. | 261/64.4 |
| 5,119,787 A | | 6/1992 | Muraji | 123/463 |
| 5,740,779 A | * | 4/1998 | Spencer-Smith | 123/394 |
| 5,794,593 A | | 8/1998 | Sugii | 123/438 |
| 6,173,959 B1 | | 1/2001 | Oikawa et al. | 277/312 |
| 6,186,482 B1 | | 2/2001 | Nomura | 261/43 |

FOREIGN PATENT DOCUMENTS

| | | | | |
|---|---|---|---|---|
| JP | 58-131347 | * | 8/1983 | 261/64.4 |

* cited by examiner

*Primary Examiner*—Richard L. Chiesa
(74) *Attorney, Agent, or Firm*—Reising, Ethington, Barnes Kisselle, P.C.

(57) ABSTRACT

A self-relieving choke valve system for a carburetor of a combustion engine automatically opens a choke valve after a successful engine start up and permits the choke valve to automatically close when the engine is shut down. The self-relieving choke valve system is preferably passive in nature and preferably self contained to the carburetor. It has a vacuum motor which preferably receives a vacuum signal from a vacuum source derived from the operating engine to open the choke valve. A lost motion linkage of the self-relieving choke valve system permits the choke valve to fluctuate between a closed position and a slightly open engine start up position without any intervention by the vacuum motor while the engine is being started.

19 Claims, 6 Drawing Sheets

SELF-RELIEVING CHOKE VALVE SYSTEM FOR A COMBUSTION ENGINE CARBURETOR

TECHNICAL FIELD

The present invention relates generally to a choke valve of a carburetor for a combustion engine, and more particularly to a self-relieving choke valve system of the carburetor.

BACKGROUND OF THE INVENTION

Conventional carburetors for internal fuel combustion engines are known to have a fuel and air mixing passage for delivering a controlled ratio of fuel-and-air to the combustion chamber of a running two or four stroke engine. The mixing passage is defined by a body of the carburetor and has a venturi disposed between an upstream region and a downstream region of the passage. Generally controlling or limiting the amount of air flowing through the venturi is a choke valve of a butterfly-type disposed within the upstream region of the passage. Generally controlling the amount of fuel-and-air mixture fed to the combustion chamber of a running engine is a throttle valve, also of a butterfly-type, which is disposed within the downstream region of the passage. As the throttle valve rotates from a substantially closed position to a wide open throttle position and the choke valve is open, the engine rpm will generally increase from idle to maximum or full power. At wide open throttle, a vacuum induced at the venturi increases with the increased air flow demand of the engine. This causes an increase in fuel flow typically from a near atmospheric fuel supply chamber, through a fuel feed passage and a fuel orifice disposed at a radially most inward portion of the venturi.

The ratio of fuel-to-air of a running engine is generally less than the ratio necessary to reliably start a cold engine. The choke valve is primarily necessary to adjust the fuel-to-air ratio by controlling the air flow rate through the upstream region of the mixing passage. Prior to starting of a cold engine, the user must first manually place the choke valve in a substantially closed or "choke-on" position. The air flow is thus limited and a rich mixture of fuel-and-air flows through an intake manifold and to the combustion chamber of the engine via the pulsating vacuum induced by the reciprocating piston(s) of the engine.

Once the engine has started, the user must remember to manual place the choke valve in an open or "choke-off" position to lean-out the fuel-and-air mixture to achieve smooth running of the engine. If the user does not timely remember to manually place the choke valve in an open or "choke-off" position after start-up, and during idle conditions, the engine may stall on an overly rich mixture of fuel-and-air, or, a black smoke will be emitted from the exhaust, indicative of an unwanted increase in hydro-carbon emissions. Moreover, if the user attempts to increase rpm's of the idling engine with the choke valve substantially closed, the air demands of the engine will not be met and the engine will stall on an excessively rich mixture of fuel-and-air.

The butterfly-type choke valve has a rotating shaft which traverses the mixing passage and extends through the body of the carburetor. A pivoting plate of the choke valve located within the upstream region of the mixing passage is secured rigidly to the rotating shaft, and when closed conforms in shape to the contours of the mixing passage. Usually the choke valve is retained in its closed and open positions by a detent arrangement.

For initial start up of the engine, the choke valve is manually moved to its closed position. Once the engine is running, the user typically must manually move the choke valve to its open position to allow an increase air flow for higher engine speeds and to prevent the engine from stalling due to an overly rich mixture of fuel and air.

SUMMARY

A "hands-off" self-relieving choke valve system for a carburetor of a combustion engine automatically opens a choke valve disposed pivotally within a fuel-and-air mixing passage of the carburetor after a successful engine start and assures automatic closure of the choke valve when the engine is shut down. The choke valve is automatically opened by a vacuum motor which receives a vacuum signal from a vacuum source derived from an operating engine to drive the opening of the choke valve. Preferably a flexible diaphragm of the vacuum motor is connected by a mechanical linkage to the choke valve to open it and the valve is yieldably biased to its closed position by a spring. Preferably, when the engine is being started and is warming up the choke valve is free to fluctuate between a closed position and a slightly open position before being fully opened by the vacuum motor.

Objects, features and advantages of this invention include a user friendly carburetor which automatically turns the choke off when the engine has successfully started, automatically assures closure of the choke valve when the engine is shut down, improves engine startup, avoids engine stalling during startup and warmup, is of a relatively simple and robust design, self contained to the carburetor, of economical manufacture and assembly, improves fuel economy, reduces engine exhaust emissions, and in service has a significantly increased useful life.

DESCRIPTION OF THE DRAWINGS

These and other objects, features and advantages of this invention will be apparent from the following detailed description, appended claims, and accompanying drawings in which:

DETAILED DESCRIPTION OF THE PREFERRED EMBODIMENTS

Figure 1:
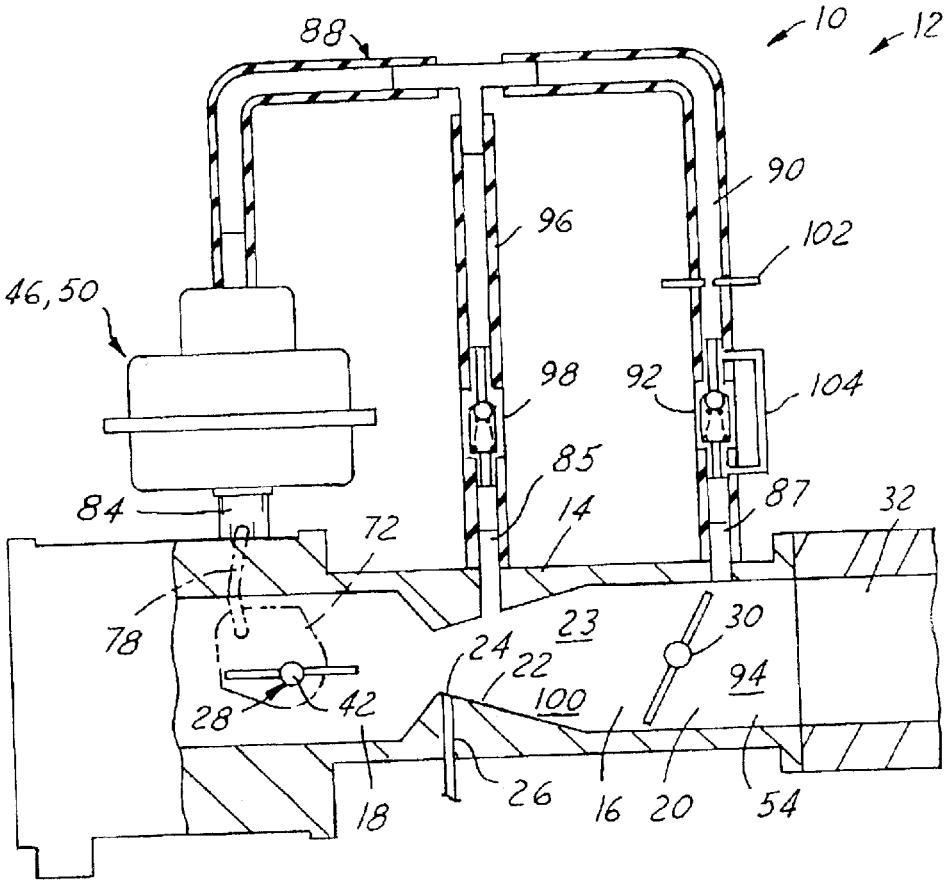
FIG. 1 is a semi-diagrammatic sectional view of a carburetor having a self-relieving choke valve system of the present invention.

Referring in more detail to the drawings, FIG. 1 illustrates a self-relieving choke valve system 10 of the present invention integrated generally into a carburetor 12 preferably for a four stroke combustion engine, such as that used for lawnmowers typically ranging from one hundred to six hundred cubic centimeters in displacement. A body 14 of the carburetor 12 carries a fuel-and-air mixing passage 16 for delivering a controlled ratio of fuel-and-air mixture to a combustion chamber of a running engine. Located between an upstream and a downstream region 18, 20 of the mixing passage 16 is a venturi 22 defined by the body that in operation induces a vacuum which causes fuel to flow through a fuel orifice 24 of a fuel feed passage 26 disposed adjacent the throat of the venturi 22 and for mixing with air. Generally controlling the amount of air flowing through the venturi 22, thus controlling the ratio of fuel-to-air of the mixture during engine startup, is a choke valve 28 preferably of a butterfly-type disposed operatively within the upstream region 18 of the mixing passage 16. A throttle valve 30, also preferably of a butterfly-type, generally controls the rate of the fuel-and-air mixture flowing into an intake manifold 32 of the combustion engine during normal operation.

Figure 6:
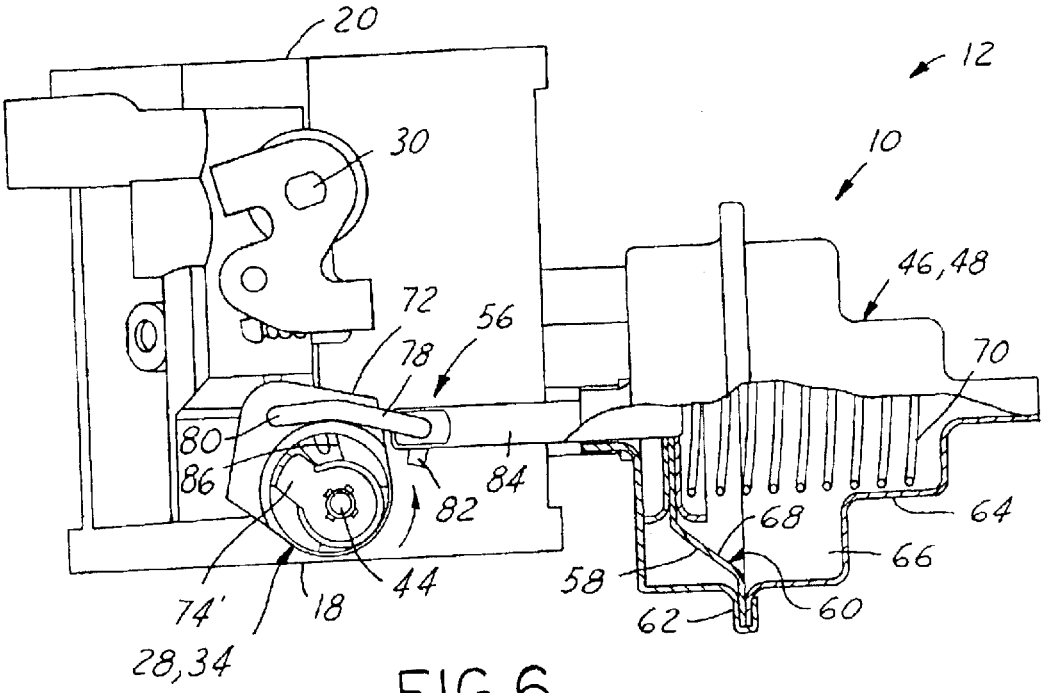
FIG. 6 is a top view of the carburetor illustrating the self-relieving choke valve in a closed position.
Figure 7:
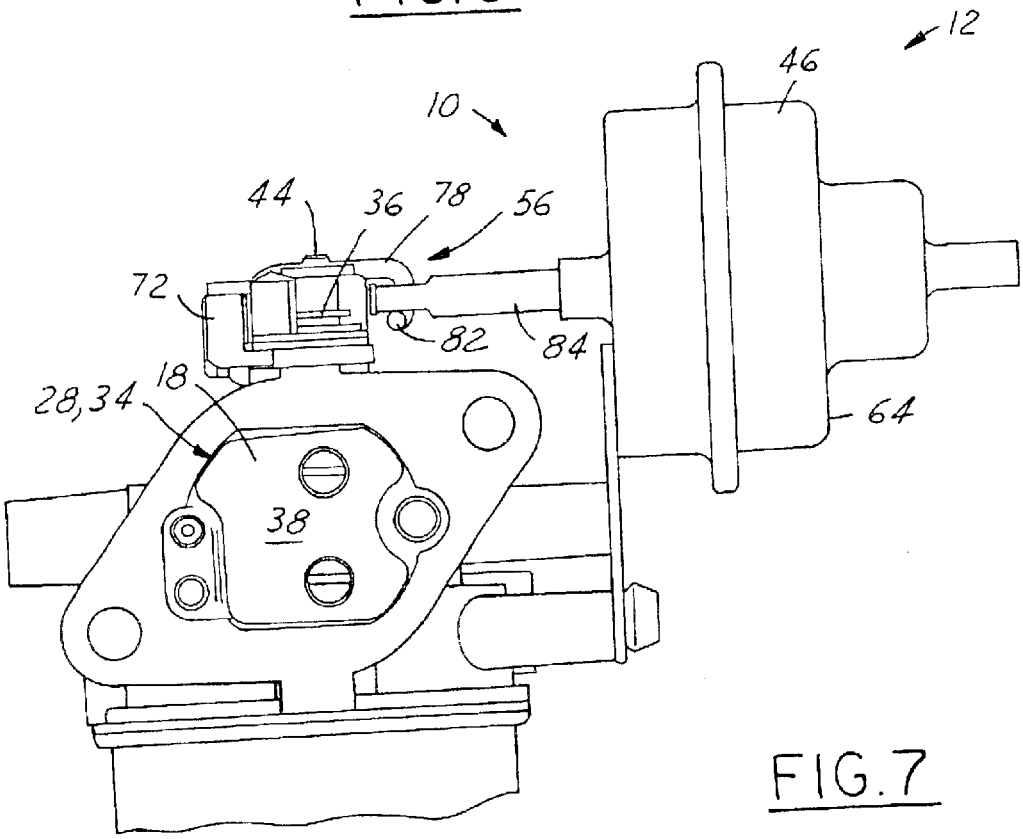
FIG. 7 is an end view of the carburetor of FIG. 3.

To reliably start a cold combustion engine, the initial supply of fuel-and-air mixture must be richer than that supplied during normal hot operating engine conditions. Therefore, and prior to starting of the cold engine, the choke valve 28 is automatically positioned into a closed position 34 or "choke-on" state by the self-relieving choke valve system 10, as best shown in FIGS. 6 and 7. When the engine is not running, and has not yet been started by the user, a coil spring 36 of the self-relieving choke valve system 10 biases the choke valve 28 into the closed position 34 which essentially isolates the fuel-and-air mixing passage 16 from an upstream supply of preferably filtered air.

Figure 8:
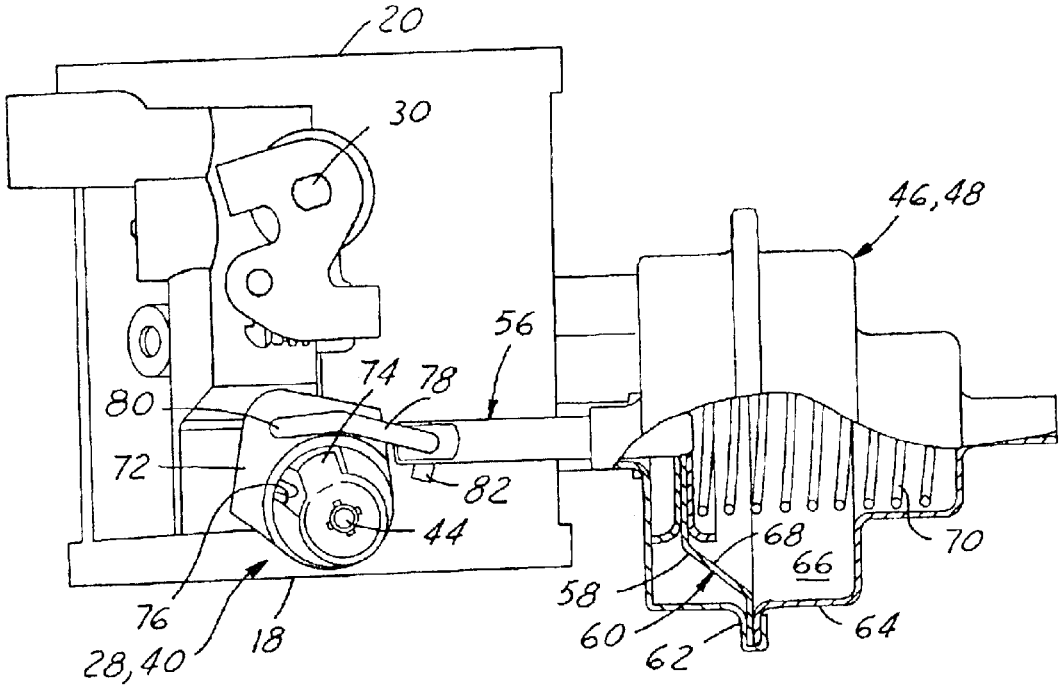
FIG. 8 is a top view of the carburetor illustrating the self-relieving choke valve in an initial start up position.
Figure 9:
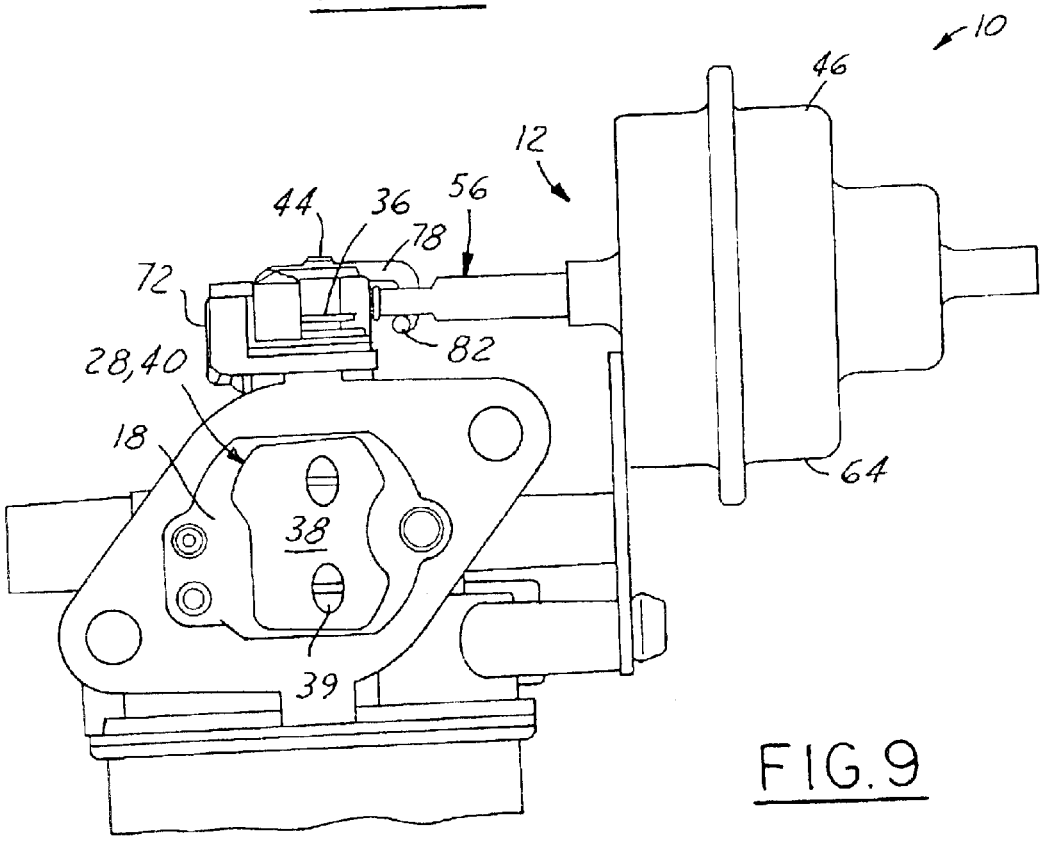
FIG. 9 is a an end view of the carburetor of FIG. 8.

During initial cranking and starting of the engine, and usually within the first four seconds, a reciprocating piston (not shown) of the engine produces a pulsating vacuum pressure within the communicating engine intake manifold 32 and the communicating fuel-and-air mixing passage 16 of the carburetor 10. Because the throttle valve 30 is substantially open, also termed as an "engine start up position," the pulsating vacuum pressure also acts upon the venturi region of the fuel-and-air mixing passage 16. This pulsating vacuum pressure generates a force acting upon the surface area of an exposed plate 38 of the choke valve 28 which overcomes the relatively small biasing force of the coil spring 36 thus causing the plate 38 of the choke valve 28 to flutter or pulsate in a pivoting manner between the closed position 34 (as best shown in FIGS. 6 and 7) and a slightly open start up position 40 (as best shown in FIGS. 8 and 9). When in the start up position 40, the choke valve 28 is generally five to ten percent open, thus allowing only a limited amount of air flow through the venturi 22 and downstream region 20 of the fuel-and-air mixing passage 16.

The same pulsating vacuum pressure produced during engine starting also acts directly upon the fuel orifice 24 of the fuel feed passage 26 at the venturi 22 causing the fuel to flow into the fuel-and-air mixing passage 16. This liquid fuel combines with the limited air flow, which has passed by the fully or partially closed choke valve 28 and through the upstream region 18, creating a rich mixture of fuel-and-air for starting the engine.

Figure 4:
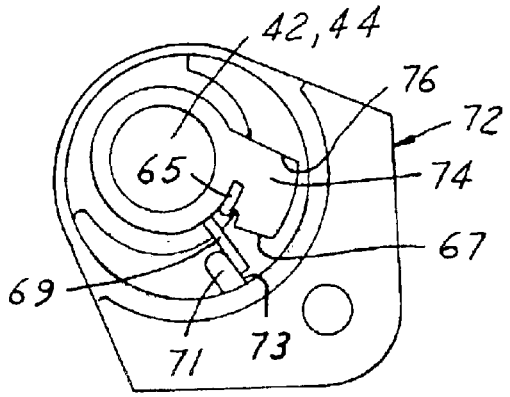
FIG. 4 is a partial top view of the carburetor taken along line 4—4 of FIG. 3.
Figure 5:
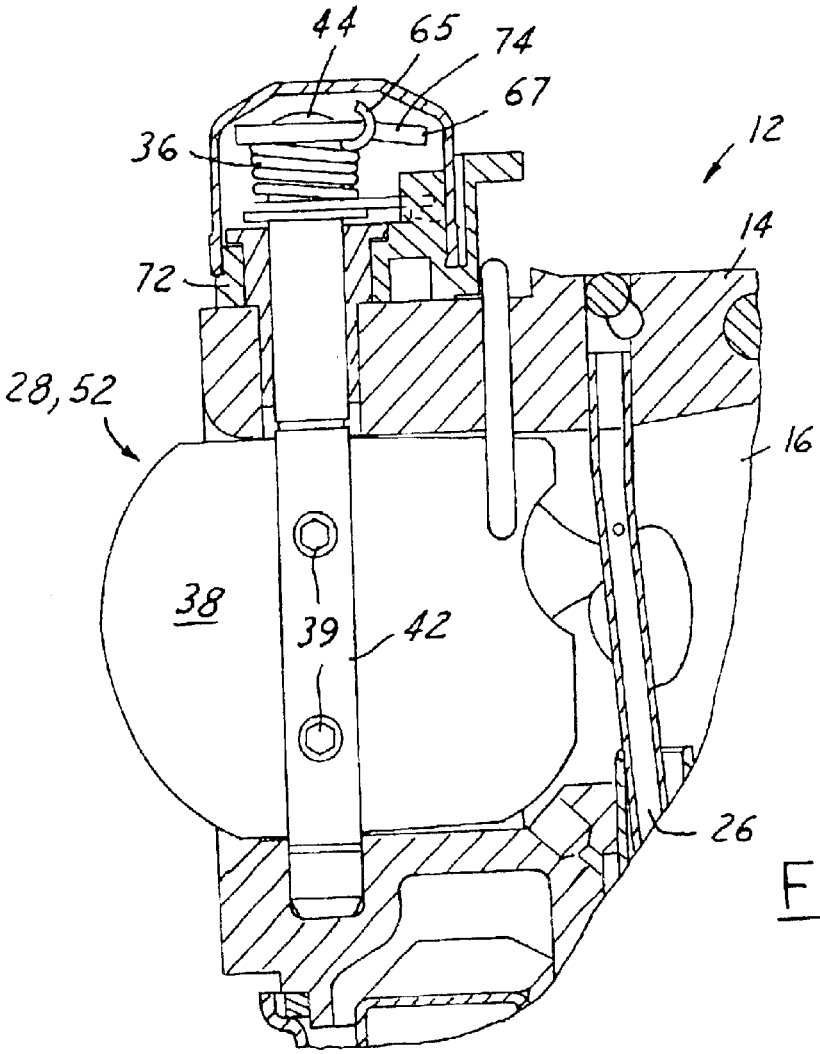
FIG. 5 is a cross section of the carburetor taken along line 5—5 of FIG. 2.

Referring to FIGS. 4 and 5, the plate 38 of the choke valve 28 substantially conforms to the cross sectional flow area of the upstream region 18 of the mixing passage 16 and is fixed by machine screws 39 to a rotating shaft 42 of the choke valve 28 which traverses the upstream region 18 and is rotatably received in the body 14 of the carburetor 10. One end of the torsion coil spring 36 is engaged to a disc-like member 72 and the opposite end engages a lever or arm 74 fixed to end portion 44 of the rotating shaft 42 which projects through the body 14. No portion of the spring 36 attaches to any stationary portion of the body 14 of the carburetor 10. The spring 36 encircles the end portion 44 of the shaft 42 and torsionally yieldably biases the choke valve 28 toward its closed position 34. The choke valve 28 moves against the bias of the spring 36 to its start up position 40 by the force induced by the pulsating vacuum pressure.

Figure 2:
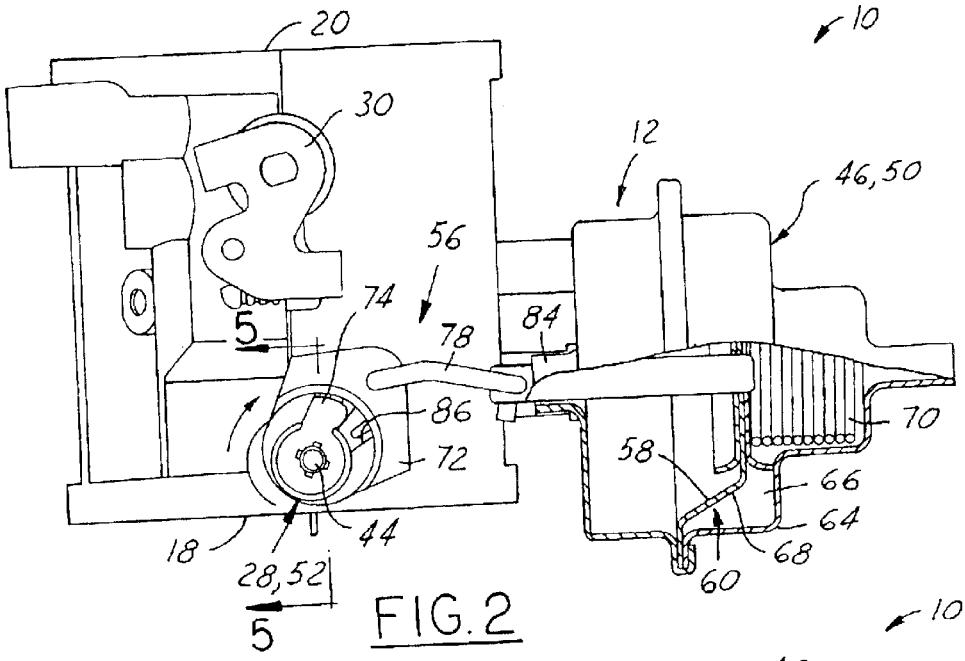
FIG. 2 is a top view of the carburetor illustrating the self-relieving choke valve in an open position.
Figure 3:
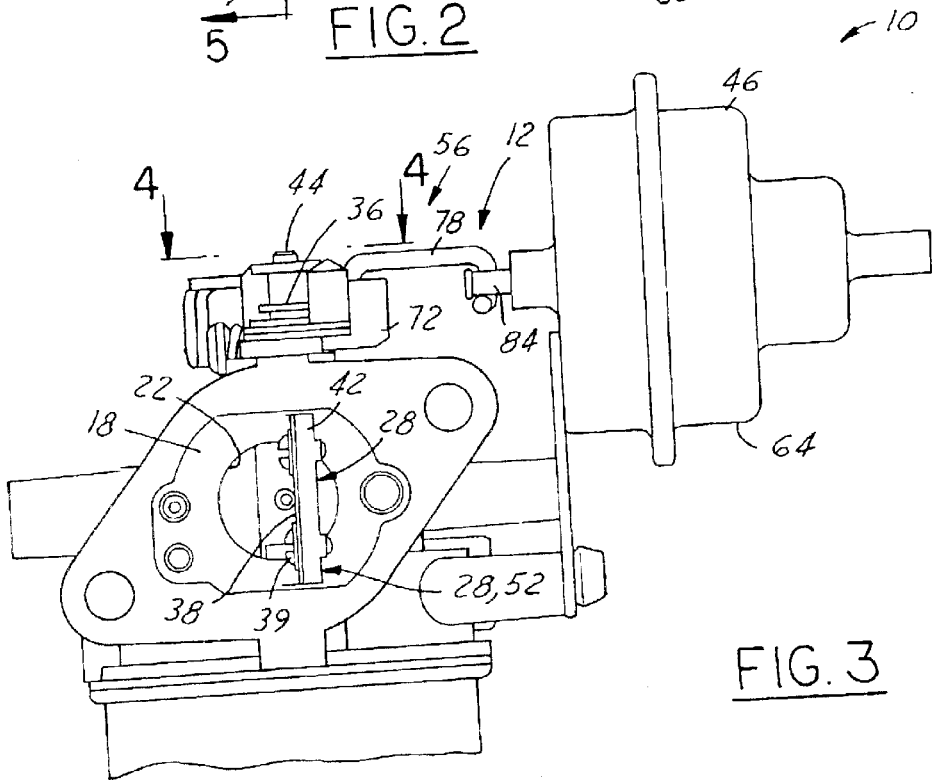
FIG. 3 is an end view of the carburetor of FIG. 2.

After initial engine starting, the choke valve 28 remains in the oscillating start up position 40 for about three to four seconds which is long enough to prevent the occurrence of "false starts," yet not so long that the engine stalls on an overly rich mixture of fuel-and-air, or the exhaust begins to emit black smoke which is an indication of unwanted high hydrocarbon emissions produced by an excessively rich mixture of fuel-and-air. After initial engine starting and this starting period, a choke positioner device or vacuum motor 46 of the self-relieving choke valve system 10 automatically moves from a deactivated state 48, wherein the choke valve 28 is free to move between the closed and start up positions 34, 40 (as best shown in FIGS. 6–9), to an activated state 50 coincidentally moving the choke valve 28 from the start up position 40 to a full open position 52 (as best shown in FIGS. 2 and 3).

Referring to FIG. 1, the choke positioner device or vacuum motor 46 preferably is actuated by a vacuum source 54. For four-stroke engine applications, the vacuum source 54 is preferably taken from the fuel-and-air mixing passage 16, but may also be taken, at least in part, from the intake manifold 32. The vacuum pressure of the vacuum source 54 is generally appreciably higher during engine running conditions than the pulsating vacuum pressure taken from the same mixing passage location during engine starting. That is, the pulsating vacuum pressure during engine start is strong enough to overcome the resilience of the coil spring 36 moving the choke valve 28 toward the substantially closed or start up position 40 (as best shown in FIGS. 3 and 5), but is not strong enough to cause the vacuum motor 46 to move from the deactivated state 48 (see FIG. 6) to the activated state 50 (see FIG. 2) which would tend to open the choke valve 28.

The vacuum motor 46 connects operatively to the external end portion 44 of the shaft 42 of the choke valve 28 via a mechanical linkage or lost motion coupling 56 connected centrally to a side 58 of a flexible diaphragm or actuator 60 of the vacuum motor 46 which moves in response to a change in the magnitude of the vacuum produced by the source 54. A peripheral edge 62 of the diaphragm 60 engages sealably to a housing 64 of the vacuum motor 46. A vacuum chamber 66 of the vacuum motor 46 which communicates with the vacuum source 54 is defined between an opposite second side 68 of the flexible diaphragm 60 and the housing 64. The vacuum motor 46 is biased into the deactivated state 48 by a compressed coil spring 70 located in the vacuum chamber 66 and bearing on the second side 68 of the diaphragm 60 and the housing 64. After the engine has been started, the increased vacuum within the vacuum chamber 66 causes the diaphragm 60 to move against the bias of the spring 70 which pulls or moves the linkage 56 to open the choke valve 28.

As the linkage 56 moves with the diaphragm 60, the disc-like member 72 of the linkage 56, through which the end portion 44 of the shaft 42 of the choke valve 28 protrudes, rotates slightly clockwise (as viewed in FIGS. 2, 6 and 7) about the shaft 42 until the radially projecting arm or lever 74 of the end portion 44 contacts an axially extending and clockwise facing cam surface 76 (as best shown in FIG. 4) carried by the disc-like member 72. At the point of contact, the choke valve 28 may be positioned anywhere between the closed position 34 and the start up position 40. However, once contact is made the choke valve 28 will only move in the opening direction. Further movement of the linkage 56 in the pull or clockwise direction causes the shaft 42 and the spring 36 to rotate with the disc-like member 72, and thus the choke valve 28 to move past the start up position 40 and toward the fully open position 52.

Referring to FIGS. 4 and 5, a first end 65 of the spring 36 engages the lever 74 of the choke valve 28 by resiliently bearing upon a leading or clockwise edge 67 of the lever 74. An opposite second end 69 of the spring 36 engages an upward projecting tab 71 of the member 72, bearing resiliently upon a counter-clockwise face 73 of the tab 71. Because the spring 36 is interconnected between the lever 74 and the member 72 (and not the body 14), the bias of the spring 70 must be strong enough to hold the member 72 of the linkage 56 steadfastly as the choke valve 28 moves between the closed and start up positions 34, 40. Likewise, the vacuum pressure derived from the vacuum source 54 need only cause the motor 46 to produce sufficient force to overcome the bias of the spring 70 of the vacuum motor 46 and not the bias of the spring 36 to fully open the choke valve 28. Since the vacuum pressure does not need to overcome the resilient force of the spring 36, the diaphragm 60 size can be minimized. However, this vacuum pressure must produce sufficient force regardless of whether the engine is idling at low rpm's or running at wide open throttle under full load conditions.

However, should the coil spring 36 of the choke valve 28 weaken or break, the strategic angular placement of a counter-clockwise facing stop surface 86 of the member 72 disposed substantially near the angular location of the arm 74 of the shaft 44 when the choke valve 28 is in the start up position 40 will assure that the choke valve 28 does not open beyond the start up position 40 when starting the engine. Consequently, the robust design of the self-relieving choke valve system 10 when in the deactivated state 48 can assist in assuring a rich mixture of fuel-and-air for cold starting of the engine. Moreover, if the coil spring 36 is broken or simply not used as part of the carburetor 10 altogether, the stop surface 86 of the member 72 will bear upon the arm 74 of the choke valve 28 when the vacuum motor 46 moves from the activated state 50 to the deactivated state 48 thus returning the choke valve 28 from the open position 52 to the start up position 40.

To simplify manufacture and assembly and reduce cost, the self-relieving choke valve system 10 is preferably passive and self-contained to the carburetor 10. Preferably, the vacuum source 54 has a tap 85 (as best shown in FIG. 1) in the venturi region 23 and a tap 87 in the downstream region 20 of the fuel-and-air mixing passage 16, both of which communicate with the vacuum chamber 66 through a conduit or tube 88. Because the vacuum pressure is highest at the venturi 22 when the engine is running at higher rpm's or wide open throttle, and is highest downstream of the substantially closed throttle, valve 30, during low engine rpm's or idling conditions, the conduit 88 has a first leg 90 having a check valve 92 which communicates between the vacuum chamber 66 and the tap 87 in the downstream region 20 or first region 94 of the mixing passage 16 and a second leg 96 having a check valve 98 which communicates between the vacuum chamber 66 and the tap 85 in the venturi 22 or second region 100 of the mixing passage. When the engine is operating at idle conditions, the check valve 98 of the second leg 96 is biased closed and the check valve 92 of the first leg 90 is held open by the vacuum in the first region 94. When the engine is operating at higher rpm's, the check valve 92 of the first leg 90 is biased closed and the check valve 98 of the second leg 98 is opened by the vacuum in the second region 100. In this way, the vacuum chamber 66 of the motor 46 experiences the maximum vacuum signal possible during all normal running conditions of the engine necessary to keep the vacuum motor 46 in the activated state 50.

Referring to FIG. 1, to prevent false starts of the engine, the choke valve 28 must not open too quickly. To slow the opening speed or delay the opening of the choke valve 28, a restrictor or restriction orifice 102 can be located in the first leg 90 of the conduit 88 between the vacuum chamber 66 and the check valve 92. The restrictor 102 will retard communication between the vacuum chamber 66 and the first region 94 when the engine is initially started, thus slowing the rate of increase of vacuum in the vacuum chamber 66 necessary to activate the vacuum motor 46. Also capable of slowing the opening speed of the choke valve 28 is a small bleed passage 104 routed around the check valve 92 of the first leg 90. Decreasing the size of the restriction orifice 102 or increasing the size of the bleed passage 104 will decrease the opening speed of the choke valve 28. The bleed passage 104 also bleeds air into the vacuum chamber 66 when the engine is shut down permitting the vacuum motor 46 to deactivate and the choke valve 28 to close.

Figure 10:
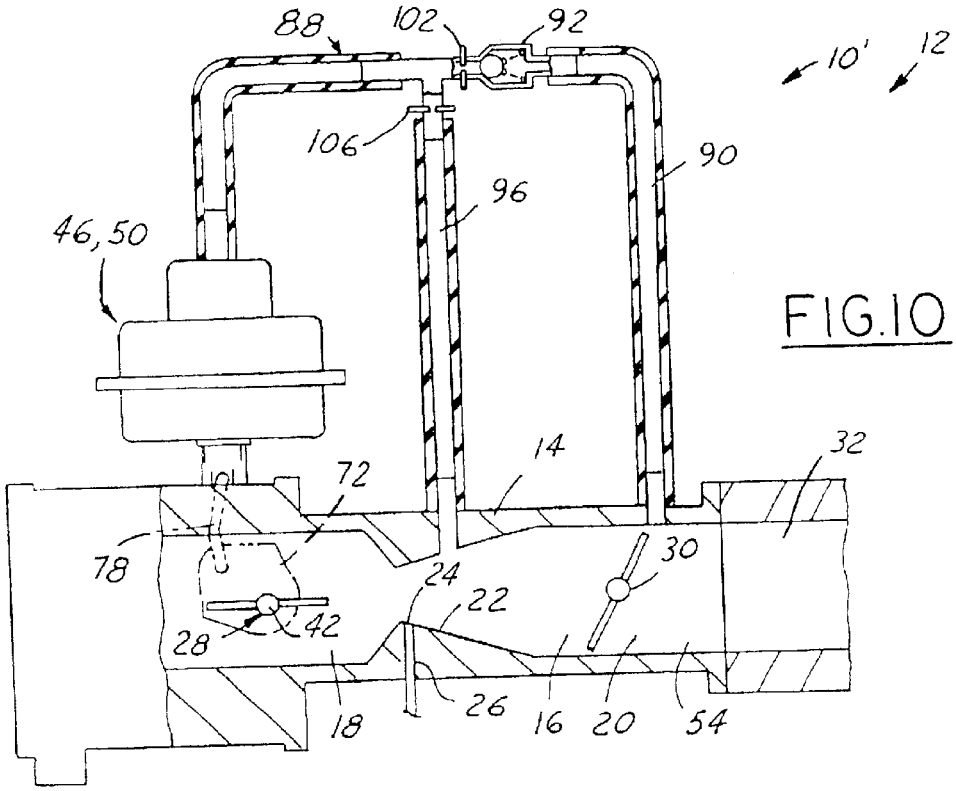
FIG. 10 is a semi-diagrammatic sectional view illustrating a modification to the carburetor shown in FIG. 1.

Referring to FIG. 10, depending upon the operating dynamics of the applicable engine, the check valve 98 of the second leg 96 can be replaced with a restrictor or orifice 106, and the bleed passage 104 of the first leg 90 can be eliminated altogether. When the operating engine is at idle or low rpm's, the vacuum necessary to activate the vacuum motor 46 is communicated through the first leg 90 while the restrictor 106 of the second leg 96 bleeds off a small amount of this vacuum signal which effectively shows the opening of the choke valve 28. The bypass bleed passage 104 is not required because the vacuum signal will bleed-off through leg 96 and the restrictor 106 when the engine is shut down. Depending upon the operating characteristics of the engine, the restriction orifice or restrictor 102 may still be utilized in the first leg 90. With this configuration the restriction orifice 102 will be substantially larger than the orifice 106 of the second leg 96. For instance, if orifice 102 is about 0.020 inches in diameter the orifice 106 will be about 0.012 inches in diameter.

Figure 11:
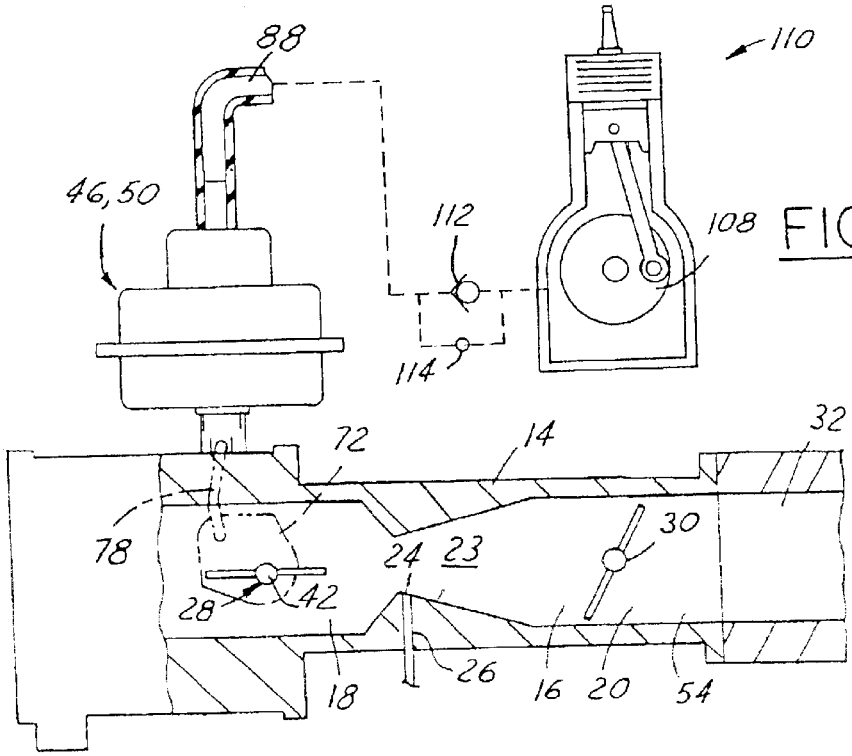
FIG. 11 is a semi-diagrammatic sectional view illustrating a modification to the carburetor shown in FIG. 10.

Referring to FIG. 11, alternatively the conduit 88 may communicate a vacuum signal to the vacuum chamber 66 from the crankcase 108 of the four-stroke combustion engine 110 which is typically under a negative pressure. Because pressure in the engine crankcase alternates between superatmospheric and subatmospheric (vacuum) values, the conduit 88 illustrated in FIG. 11 has a check valve 112. The check valve 112 is bypassed by a bleed passage 114 with a restrictor 116 for bleeding off the vacuum signal in the vacuum chamber 66 when the engine 110 is turned off. The size of the restrictor 116 in the bleed passage 114 is dictated by the displacement and operating characteristics of the engine.

While the forms of the invention herein disclosed constitute presently preferred embodiments, many others are possible. For instance, the self-relieving choke valve system can be utilized on a carburetor serving a two-stroke combustion engine. With a two stroke or cycle engine the self-relieving choke valve system utilizes a check valve arrangement capable of communicating only the vacuum pulses of the crankcase to the vacuum motor while isolating the positive pressure pulses within the crankcase. It is not intended herein to mention all the possible equivalent forms or ramifications of the invention. It is understood that terms used herein are merely descriptive, rather than limiting, and that various changes may be made within departing from the spirit or scope of the invention as defined by the following claims.

What is claimed is:

1. A self-relieving choke valve system for a carburetor of a combustion engine comprising:

a body of the carburetor;

a fuel-and-air mixing passage defined by the body;

a choke valve disposed within the fuel-and-air mixing passage, the choke valve having a closed position and being movable to an open position when the engine is running;

a vacuum motor having a housing carried by the body, a vacuum chamber, an actuator communicating with the vacuum chamber and movable relative to the housing in response to a vacuum applied to the vacuum chamber, and a mechanical linkage operably connecting the choke valve with the actuator;

a vacuum source derived from the engine and producing a vacuum signal when the engine is running which communicates with the vacuum chamber, wherein the actuator moves upon communication of the vacuum signal with the vacuum chamber to move the choke valve into the open position;

wherein the vacuum source is located in the fuel-and-air mixing passage downstream of the choke valve;

a throttle valve of the carburetor disposed within the fuel-and-air mixing passage downstream of the choke valve:

a first tap of the vacuum source located downstream of the throttle valve when in an idle position;

wherein the vacuum chamber is constructed and arranged to communicate with the first tap at least when the combustion engine is running at low engine rpms;

a venturi of the carburetor disposed within the fuel-and-air mixing passage between the choke valve and the throttle valve;

a second tap of the vacuum source located in the venturi;

wherein the vacuum chamber is constructed and arranged to communicate with the second tap at least when the combustion engine is running at high engine rpms;

a conduit between the housing of the vacuum motor and the body of the carburetor for communicating of the vacuum signal to the vacuum chamber, the conduit having a first leg communicating the first tap with the vacuum chamber and a second leg communicating the second tap with the vacuum chamber; and a check valve in the first leg, wherein the check valve is yieldably biased closed when the engine is running at high rpms and opened by the vacuum signal from the first tap when the engine is running at low rpms and the throttle valve is substantially closed.

2. The self-relieving choke valve system set forth in claim 1 which also comprises a vacuum signal restrictor in the second leg.

3. The self-relieving choke valve system set forth in claim 2 which also comprises a vacuum signal restrictor in the first leg and disposed between the check valve of the first leg and the vacuum chamber.

4. The self-relieving choke valve system set forth in claim 1 which also comprises:

a check valve in the second leg, which is yieldably biased closed when the engine is running at low rpms and the throttle valve is substantially closed and opened by the vacuum signal from the second tap when the engine is running at high rpms; and a bleed passage around the check valve of the first leg for relieving the vacuum within the vacuum chamber when the engine is shut down.

5. A self-relieving choke valve system for a carburetor of a combustion engine comprising:

a body of the carburetor;

a fuel-and-air mixing passage defined by the body;

a choke valve disposed within the fuel-and-air mixing passage, the choke valve having a closed position and being movable to an open position when the engine is running;

a vacuum motor having a housing carried by the body, a vacuum chamber, an actuator communicating with the vacuum chamber and movable relative to the housing in response to a vacuum applied to the vacuum chamber, and a mechanical linkage operably connecting the choke valve with the actuator;

a vacuum source derived from the engine and producing a vacuum signal when the engine is running which communicates with the vacuum chamber, wherein the actuator moves upon communication of the vacuum signal with the vacuum chamber to move the choke valve into the open position;

the actuator being a flexible diaphragm having a first side defining in-part the vacuum chamber and an opposite second side;

a rotating shaft of the choke valve traversing through the fuel-and-air mixing passage, the shaft having an end portion disposed outside the body of the carburetor;

a rotating member of the mechanical linkage constructed and arranged to intermittently engage the end portion of the shaft; and a rod of the mechanical linkage engaged pivotally at one end to the rotating member and engaged pivotally at an opposite end to the second side of the diaphragm.

6. The self-relieving choke valve system set forth in claim 5 which also comprises:

the choke valve having a closed position and a start-up position orientated between the closed and open positions;

the vacuum motor having a deactivated state and an activated state, wherein the vacuum motor is yieldably biased into the deactivated state and is resiliently held in the activated state when the vacuum chamber receives the vacuum signal;

wherein the shaft of the choke valve rotates relative to the rotating member when the choke valve pivots between the closed and start-up positions and the vacuum motor is in the de-activated state; and wherein the rotating member rotates the shaft of the choke valve when the vacuum motor is in the activated state to move the choke valve to its open position.

7. The self-relieving choke valve system set forth in claim 6 comprising:

an arm projecting radially outward from the end portion of the shaft;

a first stop surface of the member disposed in opposition to the arm;

wherein the arm moves circumferentially away from the first stop surface when the choke valve pivots from the closed position to the start-up position; and wherein the first stop surface is engaged with the arm when the vacuum motor is in the activated state.

8. The self-relieving choke valve system set forth in claim 7 comprising:

a second stop surface carried by the member and circumferentially spaced apart from and opposed to the first stop surface; and wherein the arm is disposed circumferentially between the first and second stop surfaces.

9. The self-relieving choke valve system set forth in claim 6 comprising:

a coil spring of the vacuum motor disposed in the vacuum chamber and being compressed between the diaphragm and the housing to bias the vacuum motor into the deactivated state; and a spring of the choke valve wound about the end portion of the shaft and engaged at one end to the rotating member and engaged at the other end to the end portion for yieldably biasing the choke valve into the closed position when the engine is not running.

10. The self-relieving choke valve system set forth in claim 5 wherein the choke valve has a spring wound about the end portion of the shaft and engaged at a first end to the rotating member and being engaged at an opposite second end to the end portion for biasing the choke valve into the closed position.

11. The self-relieving choke valve system set forth in claim 10 comprising:

a lost motion coupling having the rotating member and an arm projecting radially outward from the end portion of the shaft; and wherein the second end of the spring is engaged to the arm.

12. The self-relieving choke valve system set forth in claim 5 wherein the shaft is journaled for rotation relative to the rotating member and the rotating member is independent of the body.

13. The self-relieving choke valve system set forth in claim 5 wherein the vacuum source is a crankcase of the combustion engine.

14. The self-relieving choke valve system set forth in claim 13 wherein the combustion engine is a four-stroke engine.

15. A self-relieving choke valve system for a carburetor of a combustion engine comprising:

a body of the carburetor;

a fuel-and-air mixing passage defined by the body;

a choke valve disposed within the fuel-and-air mixing passage, the choke valve having a closed position and being movable to an open position when the engine is running;

a vacuum motor having a housing carried by the body, a vacuum chamber, an actuator communicating with the vacuum chamber and movable relative to the housing in response to a vacuum a plied to the vacuum chamber, and a mechanical linkage operably connecting the choke valve with the actuator;

a vacuum source derived from the engine and producing a vacuum signal when the engine is running which communicates with the vacuum chamber, wherein the actuator moves upon communication of the vacuum signal with the vacuum chamber to move the choke valve into the open position; and a lost motion coupling engaged operably between the choke valve and the vacuum motor permitting the choke valve to move between the closed position and a slightly open start up position when the vacuum signal is not applied to the vacuum chamber.

16. A self relieving self-relieving choke valve system for a carburetor of a combustion engine comprising:

a body of the carburetor;

a fuel-and-air mixing passage defined by the body;

a choke valve disposed in the fuel-and-air mixing passage, the choke valve being in a closed position when the engine is not running, movable to an initial start up position which limits air flow through the fuel-and-air mixing passage providing a rich mixture of fuel-and-air when the engine is being initially started, and an open position when the engine is running at higher rpms;

a vacuum motor having a housing carried by the body, a vacuum chamber, and a flexible diaphragm communicating with the vacuum chamber and housing;

a lost motion coupling connecting the choke valve with the diaphragm;

a spring engaged between the choke valve and the lost motion coupling for yieldably biasing the choke valve into the closed position;

wherein the vacuum motor and lost motion coupling are constructed and arranged to yieldably bias the choke valve to the closed position when the engine is not running; and wherein the vacuum chamber is constructed and arranged to communicate directly with the fuel-and-air mixing passage downstream of the choke valve when the engine is running to place the vacuum chamber under a subatmospheric pressure thus overcoming the bias of the vacuum motor and moving the choke valve into the open position.

17. A self relieving choke valve system for a carburetor of a combustion engine comprising:

a body of the carburetor;

a fuel-and-air mixing passage carried by the body;

a choke valve orientated operably in an upstream region of the fuel-and-air mixing passage, the choke valve having a closed position, an open position, a start-up position configured between the closed and open positions, and a rotating shaft which traverses the upstream region of the fuel-and-air mixing passage;

a vacuum motor having a vacuum chamber, a deactivated state and an activated state;

wherein the vacuum motor is in the activated state when the vacuum chamber is under a first subatmospheric pressure thus overcoming the bias of the vacuum motor and moving the choke valve into the open position;

a lost motion coupling having an arm projecting radially outward from an end portion of the shaft and a member mounted rotatably to the end portion and coupled to the vacuum motor; and a spring for biasing the choke valve from the start up position to the closed position only when the vacuum motor is in the deactivated state, the spring being engaged to the arm at a first end and to the member at an opposite second end.

18. The self-relieving choke valve system set forth in claim 17 wherein the choke valve is in the start up position when the vacuum motor is in the deactivated state and the upstream region is under a second subatmospheric pressure thus overcoming the biasing force of the spring.

19. The self-relieving choke valve system set forth in claim 18 wherein the first subatmospheric pressure is greater than the second subatmospheric pressure.

* * * * *

UNITED STATES PATENT AND TRADEMARK OFFICE

CERTIFICATE OF CORRECTION

PATENT NO. : 6,851,664 B2
DATED : February 8, 2005
INVENTOR(S) : Bryan K. Gangler et al.

It is certified that error appears in the above-identified patent and that said Letters Patent is hereby corrected as shown below:

Column 7,
Line 17, delete the colon "(:)" and insert a semicolon -- (;) --.
Line 40, delete "a plied" and insert -- applied --.

Signed and Sealed this

Tenth Day of May, 2005

JON W. DUDAS
*Director of the United States Patent and Trademark Office*